US005747712A

United States Patent [19]

Goto

[11] Patent Number: 5,747,712

[45] Date of Patent: May 5, 1998

[54] PEG FOR A STRINGED INSTRUMENT

[75] Inventor: Takao Goto, Isezaki, Japan

[73] Assignee: Gotoh Gut Yugen Kaisha, Isezaki, Japan

[21] Appl. No.: 818,663

[22] Filed: Mar. 14, 1997

[30] Foreign Application Priority Data

Mar. 29, 1996 [JP] Japan ..... 8-111793

[51] Int. Cl.[6] ..... G10D 3/14

[52] U.S. Cl. ..... 84/306; 84/304

[58] Field of Search ..... 84/306, 304, 297 R

[56] References Cited

U.S. PATENT DOCUMENTS 2,448,308 8/1948 Gregg ..... 84/306

4,827,825 5/1989 Goto et al. ..... 84/306

OTHER PUBLICATIONS

Catalog—Gotoh, "Guitar & Bass Parts", Collection 1996, Jan. 16, 1996.

*Primary Examiner*—Michael L. Gellner

*Assistant Examiner*—Shih-yung Hsieh

*Attorney, Agent, or Firm*—Wenderoth, Lind & Ponack

[57] ABSTRACT

A peg for a stringed instrument has a winding shaft made up a base shaft portion having a free end and adjustable shaft portion. The adjustable shaft portion is in threaded engagement with the free end of the base shaft portion. The base shaft portion is connected with a worm gear, with the worm gear being connected to a knob for adjustment of the rotational position of the winding shaft. A fixing screw member is located in the base shaft portion, and is axially engageable with the bottom surface of the adjustable shaft portion. Accordingly, the position of the outer string winding surface of the adjustable shaft portion is axially adjustable, and is axially fixable by the fixing screw member.

20 Claims, 6 Drawing Sheets

PEG FOR A STRINGED INSTRUMENT

BACKGROUND OF THE INVENTION

1. Field of the Invention

The present invention relates to a peg for use in a stringed instrument such as a guitar.

2. State of the Prior Art

A convention peg for use in a stringed instrument such a guitar has a structure such as shown by FIG. 6. A knob, not illustrated in the figure, is used to rotate a winding shaft 1 to wind a string 2 on the shaft, as illustrated. A worm 4 is connected to the knob, and is inserted into a housing 3. The worm 4, inside the housing 3, engages a worm gear 5 that is secured to the winding shaft 1. Thus when the knob is rotated, the rotational force transmitted to the winding shaft 1 through the worm 4 and the worm gear 5 causes rotation of the winding shaft 1. By the changing the direction of rotation of the knob, the string 2 can be either wound or unwound.

The housing 3 has a fixing edge 6 that projects from the housing as illustrated in the figure. A number of through-holes are provided in the fixing edge 6 so that the housing 3 can be secured to a head portion 8 of a stringed instrument by screws 7 that are inserted into the fixing holes and screwed into the head portion 8.

The head portion 8 has a throughhole 8' through which the winding shaft 1 extends. A bush 9 is fitted into the through-hole 8' so as to provide decoration at the edge of the throughhole 8'. The bush 9 is further provided and adapted to prevent the winding shaft 1 from being tilted or inclined due to the tension of the string 2 pulling on the winding shaft 1.

Also known as one means for securing the housing 3 to the head portion 8 is a structure in which the housing 3 has a cylindrical portion projecting into the throughhole 8', with a threaded cylinder being inserted from the open side of the throughhole 8' and threaded into the cylindrical opening so that the housing is secured to the head portion 8.

OBJECTS OF THE INVENTION

The conventional peg for a stringed instrument discussed above has a winding shaft 1 formed into a single shaft body. As such, the shaft length of the winding shaft 1 cannot be adjusted for each different stringed instrument.

Stringed instruments, for example, guitars, have a structure in which six strings are wound by six pegs provided on a head portion of the instrument. The six pegs are usually mounted in one of two ways. Three of the pegs can be mounted on each side of the head portion, or all six of the pegs can be mounted in line on one side of the head portion.

With this arrangement, the strings are supported in parallel on a nut device provided between the head portion and the neck portion of the stringed instrument. Because the head portion is inclined relative to the neck portion, the respective strings are strained at angles relative to a surface of the head portion between the nut device and the corresponding pegs. The angles of the respective strings, relative to the surface of the head portion, are different from each other, because there are different distances between the nut device and the pegs. This is due to the fact that the winding shafts of the pegs have the same length projecting from the surface of the head portion.

The different angles of the respective strings relative to the surface of the head portion cause different pressures, i.e. different stresses, to be applied to the nut device by the tension force of the strings. The largest angle between the strings and the surface of the head portion is the angle created by the string that is wound by the peg nearest to the nut device. As the distance from the nut device to the pegs increases, the angle between the string and the surface of the head portion decreases. For this reason, the string that is wound by the peg closest to the nut device will apply the largest stress to the nut device. The difference between the stresses applied by the respective strings to the nut device presents the following problems.

First, if the stress that is applied by the string to the nut device is sufficiently large, the vibration energy of the string is effectively insulated by the nut device. On the other hand, if the stress applied by the string to the nut device is small, the vibration energy of the string is, undesirably, transmitted to the peg. As a result, the problem arises in that the tone color of the string is adversely affected by the propagation of the vibration energy of the string. Second, as the stress applied by the string to the nut device increases, the person playing the stringed instrument will feel a stronger tension of the string. Consequently, if the stresses that are applied by the six strings are different from each other, the finger-touch or feel given by the strings to the player of the instrument is deteriorated, resulting in the fact that the guitar is not easy to play.

Further, in the case of a guitar that is equipped with a tremolo device, if the stresses applied by the strings to the nut device are different from each other, the string that applies a larger stress to the nut device has a larger frictional resistance against the nut device when the string that is plucked returns to its original position. This results in the problem in that a smooth return of the string is disturbed.

The above-described problems relate to guitars. In other stringed instruments, for example five string-type bass guitars, because the fifth string is larger in diameter than the remainder of the strings, there is a requirement that the stress applied by the fifth string to the nut device is especially increased with respect to the other strings in order to prevent the attenuation of the vibration energy of the fifth string. To achieve this, it is required to increase the angle between the fifth string and the surface of the head portion by shortening the length of the winding shaft of the peg that is disposed nearest to the nut device so that the stress applied by the fifth string to the nut device is further increased. However, conventional pegs cannot meet such requirements, because the shaft length of the winding shaft of conventional pegs is constant and unadjustable.

SUMMARY OF THE INVENTION

Thus, in accordance with the present invention, a winding shaft is divided into a base shaft portion and an adjustable shaft portion. The base shaft portion is secured to a worm gear, and the adjustable shaft portion is in threaded engagement with the base shaft portion so as to cover the base shaft portion. As such, the adjustable shaft portion can be moved in the vertical direction, that is, in the axial direction, in accordance with the length of the threaded engagement. A fixing screw member fixes the adjustable shaft portion at a required position. The fixing screw member is preferably provided in the base shaft portion. This screw member is threadably engaged with the base shaft portion and is able to apply an axial pressing force to the bottom surface of the adjustable shaft portion when operated from the outside.

More specifically, the present invention provides a peg for a stringed instrument in which a winding shaft comprises a base shaft portion having a free end and adjustable shaft portion having a bottom surface. The adjustable shaft portion is in threaded engagement with the free end of the base shaft portion. A worm gear is provided, with the base shaft portion being connected with the worm gear. A fixing screw member is located in the base shaft portion and is actually engageable with the bottom surface of the adjustable shaft portion.

The adjustable shaft portion is preferably axially adjustable relative to the base shaft portion and the fixing screw member is axially adjustable relative to the base of the shaft portion so as to engage the bottom surface of the adjustable portion. The adjustable shaft portion has one of the first female thread and the first male thread, and the base shaft portion has the other of the first female thread and the first male thread, with the first male thread being engaged with the first female thread. Preferably the fixing screw member comprises a second thread engaged with the other of the first female thread and the first male thread. The other of the first female thread and the first male thread is preferably the first female thread, with the second thread being the second male thread.

The adjustable shaft portion can also comprise the first female thread, with the base shaft portion comprising the first male thread. The base shaft portion can further comprise the second female thread and the fixing screw member can comprise the second male thread engaged with the second female thread. The first and second female threads as preferably opposite in thread direction.

Thus, the fixing screw member is threadedly engaged with the base shaft portion by threads that are opposite in thread direction to the threaded engagement between the adjustable shaft portion and the base shaft portion.

The base shaft portion preferably has an opening therein through which the fixing screw member can be accessed. The fixing screw member has a front surface for engagement with the bottom surface of the adjustable shaft portion and a rear surface having a tool engaging formation. The tool engaging formation faces the opening of the base shaft portion. The base shaft portion further preferably has a second end opposite to the free end, with the worm gear being connected to the base shaft portion at the second end, and the opening being located at the second end.

The adjustable shaft portion comprises the string winding surface.

Thus with the peg according to the present invention, when the peg is fitted to the head portion of a stringed instrument, the length of the winding shaft can be adjusted by changing the length of engagement between the adjustable shaft portion and the base shaft portion. After the length of the winding shaft has been adjusted as required, the fixing screw member is rotated in the threaded hole to apply a pressing force to the bottom surface of the adjustable shaft portion. As a result, the threads of the female-threaded portions of the base shaft portion are brought into press contact with the threads of the male-threaded portion of the adjustable shaft portion so that frictional force is generated therebetween. Thus, both the shaft portions are fixed without causing any rotation thereof.

Furthermore, the threads of the male threaded portion and the female threaded portion are formed in directions such that the male threaded and the female threaded portions are tightened with respect to each other by the tension of a string wound on the winding shaft. For example, the case where the tension of the string is applied to a winding shaft in the clockwise direction, the female and male threaded portions have right-handed threads so that the winding shaft is tightened by the right-handed rotation of the adjustable shaft portion.

Accordingly, in the case where a guitar of a type having six pegs disposed sequentially on one side of the head portion, the six pegs needs to have their throats formed in the same direction. On the other hand, with a guitar of a type having six pegs in which three pegs are provided on each side of the head portion, the three pegs fitted on one side of the head portion have their threads cut in a direction opposite to the threads of the remaining three pegs, disposed on the other side of the head portion.

BRIEF DESCRIPTION OF THE DRAWINGS

Other objects, features and advantages of the present invention will become apparent from the following detailed description with reference to the accompanying drawings, in which.

DETAILED DESCRIPTION OF THE PREFERRED EMBODIMENTS

Figure 1:
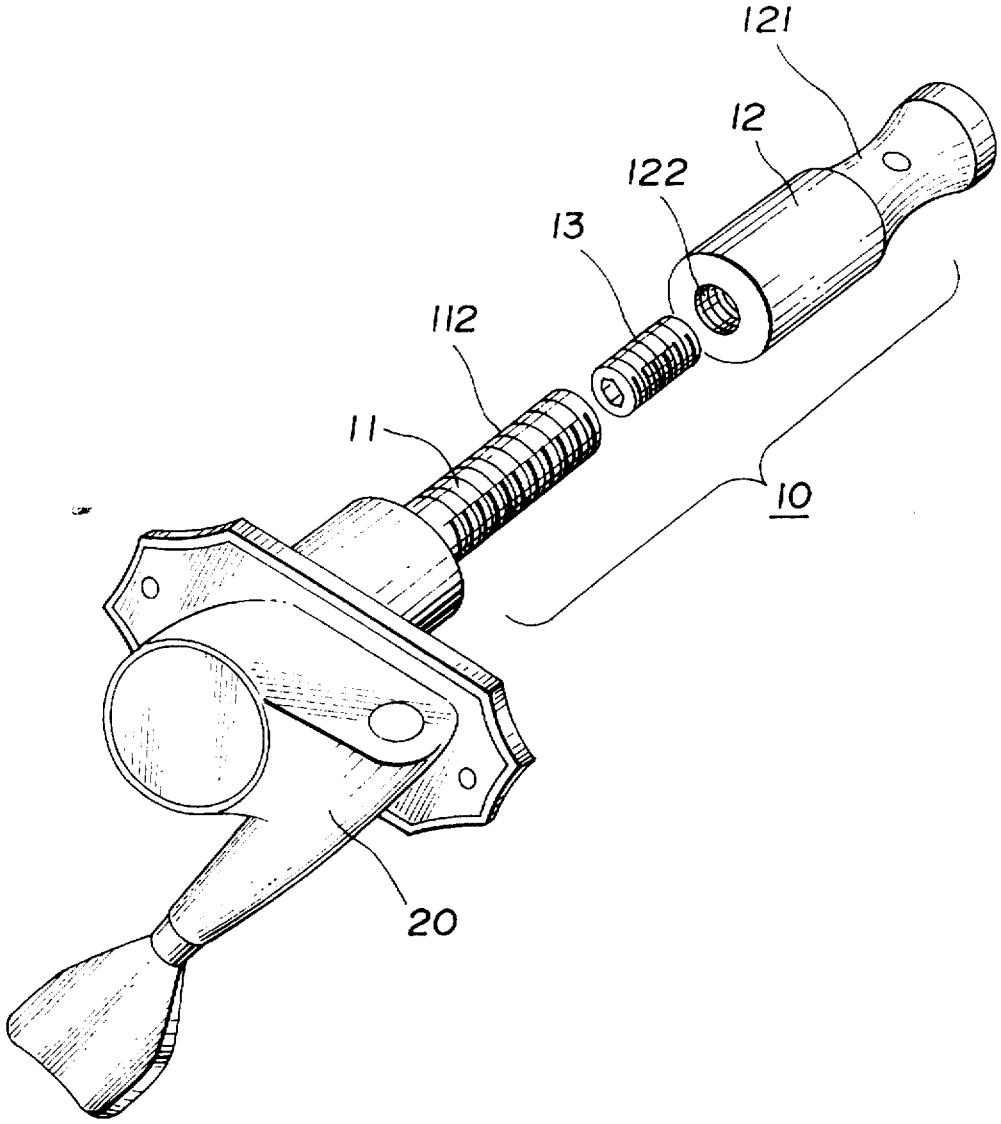
FIG. 1 is an exploded perspective view of a peg of a stringed instrument according to a first embodiment of the present invention.
Figure 2:
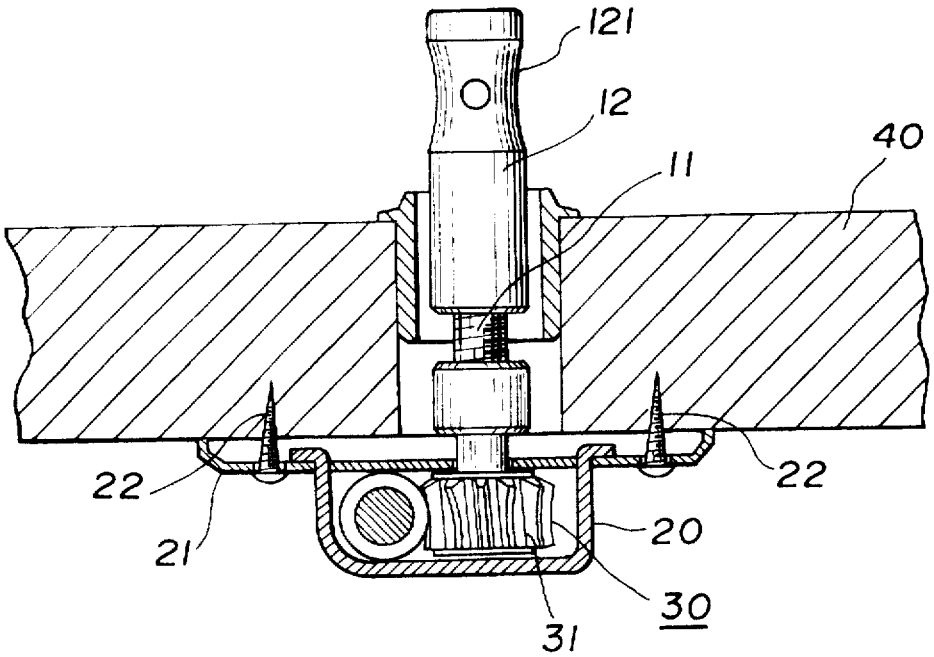
FIG. 2 is a front view that is partially in cross section of the peg according to the present invention of the first embodiment, showing the peg attached to a head portion of a stringed instrument.

Referring now to FIG. 1, a peg according to the present invention is shown in perspective and exploded view. A winding shaft 10 rotatably projects from a housing 20. The winding shaft 10 can be rotated by a worm gear mechanism 30 that is accommodated in the housing 20 as shown in FIG. 2.

The winding shaft 10 comprises a base shaft portion 11 that is secured to a central portion of a worm gear 31 of the worm gear mechanism 30. The shaft 10 further comprises an adjustable shaft portion 12 that can be threadedly engaged with a free end of the base shaft portion 11 so as to cover the free end as shown in FIG. 2. The length of threaded engagement between the adjustable shaft portion 12 and the base shaft portion 11 can thus be changed by rotating the one relative to the other, thereby enabling axial movement of the adjustable shaft portion 12.

Figure 3:
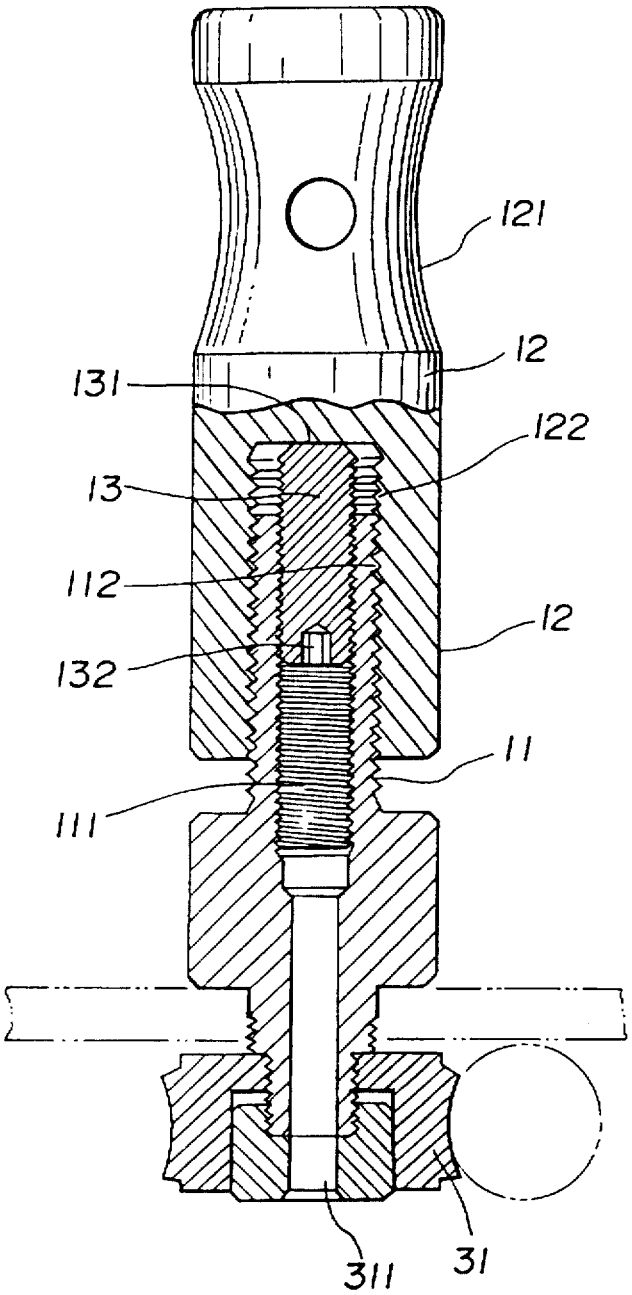
FIG. 3 is a front view that is also partially in cross section of a winding shaft of the peg of FIGS. 1 and 2.

As shown in FIG. 3, the base shaft portion 11 has a threaded hole 111 therein that communicates with the outside thereof through a through hole 311 that is formed at a central portion at the worm gear 31. The base shaft portion 11 further has, in its outer surface at the free end thereof, a male threaded portion 112. The threaded hole 111 is open at the end of the male threaded portion 112, i.e. at the free end of the base shaft portion 11.

The adjustable shaft portion 12 has a string winding surface 121 on the outer surface thereof, and also includes a female threaded portion 122 on the inside thereof opening on a side of the adjustable shaft portion 12 that faces the base shaft portion 11. The female threaded portion 122 is threadedly engaged with the male threaded portion 112 of the base shaft portion 11.

A fixing screw member 13 is threaded into engagement with the threaded hole 111 of the base shaft portion 11. The fixing screw member 13 has a flat top surface 131 and a rear surface opposite to the flat top surface 131. A tool receiving portion 132, for example a wrench hole, is provided in the rear surface of the fixing screw member 13. This portion faces toward the worm gear 31 so as to be accessible through the through hole 311.

The top surface 131 of the fixing screw member 13 projects over the top of the threaded hole 111, i.e. over the top of the free end of the base shaft portion 11. The threaded hole 111 and the fixing screw member 13 have threads formed in such a manner that the fixing screw member 13 can be strongly pressed onto the bottom surface of the adjustable shaft portion 12. More specifically, as can be seen in FIG. 3, the top surface 131 engages an inner bottom surface of the female threaded portion 122 formed inside the adjustable shaft portion 12. The threads are formed so that when a force acting in a direction in which the string is wound is applied to the fixing screw member 13, the fixing screw member 13 is strongly pressed onto the bottom surface of the adjustable shaft portion 12.

The male threaded portion 112 and the fixing screw member 13 are operated so that the male threaded portion 112 is threaded deep into the female threaded portion 122 so as to urge the adjustable shaft portion 12 toward the base shaft portion 11 when the string is wound around the adjustable shaft portion 12 and the tension of the string is applied to the winding shaft 10. The fixing screw member 13 is so designed that it simultaneously moves into the female threaded portion 122. That is, as the tension of the string applied to the winding shaft 10 tends to turn the adjustable shaft portion 12 so that the female threaded portion 122 is further threaded onto the male threaded portion 112, i.e., further onto the base shaft portion 11, any tendency to also turn the fixing screw member 13 tends to turn the fixing screw member 13 so that it will move out of the base shaft portion 11 due to the nature of the threaded engagement between the fixing screw member 13 and the threaded hole 111. Thus, the application of the tension of the string simply serves to further tighten and affix the adjustable shaft portion 12, because the rotation in the one direction tends to move the adjustable shaft portion 12 and affixing screw member 13 toward each other. In this embodiment, therefore, if the male threaded portion 112 and the female threaded portion 122 have right-handed threads, the fixing screw member 13 and the threaded hole 111 have left-handed threads.

Because the peg according to the present invention has the structure as described above, the length of the winding shaft 10 can be changed by rotating the adjustable shaft portion 12 so that the position its string winding surface 121 is shifted in the axial direction. After the shaft length has been adjusted to the required length, a rod, tool or wrench is fitted into the hole 132 shown in FIG. 3 so as to rotate the fixing screw member 13. The fixing screw member 13 is rotated so that its top surface 131 is brought into pressure contact with the inner bottom of the female threaded portion 122 so that the fixing screw member 13 applies a strong pressing force to the inner bottom of the female threaded portion 122.

Figure 4A:
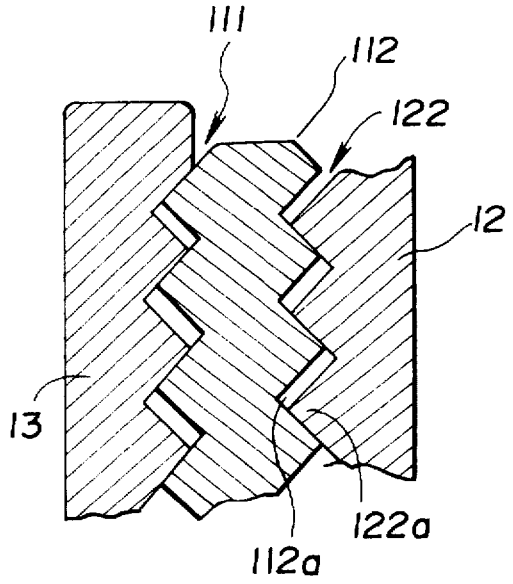
FIGS. 4A and 4B are diagrams explaining the operation of the peg for a stringed instrument according to the present invention.
Figure 4B:
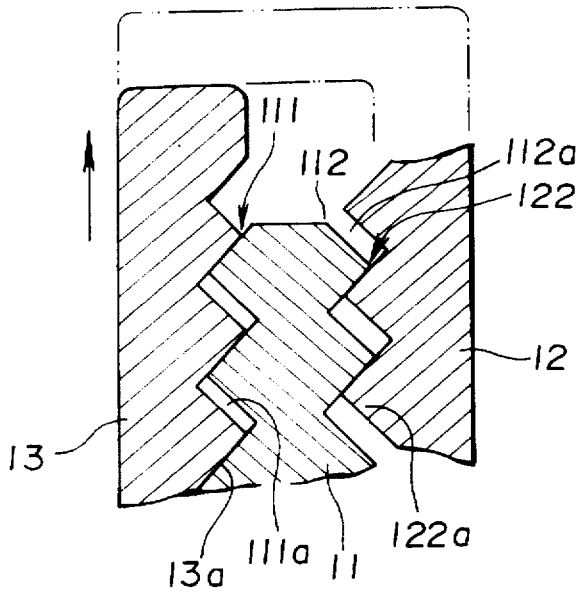

Referring now to FIG. 4A, when the length of the shaft is adjusted, the threads **122*a* of the female threaded portion 122 are in contact with the lower side of each thread groove 112*a* of the male threaded portion 112. On the other hand, when the fixing screw member 13 is strongly pressed against the inner bottom surface of the female threaded portion 122, the fixing screw member 13 pushes the adjustable shaft portion 12 upward in such a manner that the inner bottom surface of the female threaded portion 122 functions as the point of application of the pressing force. As a result, the threads 122*a* of the female threaded portion 122 are brought into contact with an upper side of the thread groove 112*a* of the male threaded portion, as shown in FIG. 4B. Frictional force is thus generated therebetween. Simultaneously, the threads 13*a* of the fixing screw member 13 are brought into contact with the lower portion of each thread groove 111*a* of the threaded hole 111, as further shown in FIG. 4B**, also generating frictional force therebetween.

Accordingly, the base shaft portion 11, the adjustable shaft portion 12 and the fixing screw member 13 are frictionally connected with one another by the axial pressing force exerted by the fixing screw member 13 on the adjustable shaft portions 12. As a result, these elements are fixedly secured together.

Furthermore, when the axial length of the winding shaft 10 is intended to be readjusted, the fixing screw member 13 is required to be loosened by using the wrench or tool. Thus, the frictional connection between the base shaft portion 11 and the adjustable shaft portion 12 is released, enabling the adjustable shaft portion 12 to be rotated freely.

The peg according to the present invention has a structure such that the threads of the male threaded portion 112 of the base shaft portion 11, the female threaded portion 122 of the adjustable shaft portion 12, the fixing screw member 13 and the threaded hole 111 are brought into pressure contact with each other, resulting in a fixing force therebetween, as shown and described above with respect to FIGS. 4A and 4B. Thus the peg according to the present invention is generally adapted so that when the tension of the string is applied to the winding shaft 10, the length of threaded engagement between the male threaded portion 112 and the female threaded portion 122 is increased and the length of the threaded engagement between the fixing screw member 13 and the threaded hole 111 is decreased. That is, the pressing force exerted by the fixing screw member 13 on the adjustable shaft portion 12 is increased in proportion to the tension of the string. However, this condition is not necessarily required in accordance with the present invention, as is described below.

That is, because the peg according to the present invention has the structure such that when the fixing screw member 13 pushes upwardly on the adjustable shaft portion 12, a strong frictional connection force is generated between the base shaft portion 11 and the adjustable shaft portion 12, if the frictional connection force attained by the fixing screw member 13 is sufficiently larger than the tension force of the string which acts on the adjustable shaft, the adjustable shaft portion 12 can be effectively be prevented from loosening due to the tension of the string.

Referring again to FIG. 2, it can be seen that a housing 20 has a mounting member 21 thereon, the mounting member 21 having through holes therein. Screws 22 attach the mounting member 21 to a head portion 40 of the stringed instrument. The worm gear 31 of the worm gear mechanism 30 is housed inside the housing 20.

Figure 5:
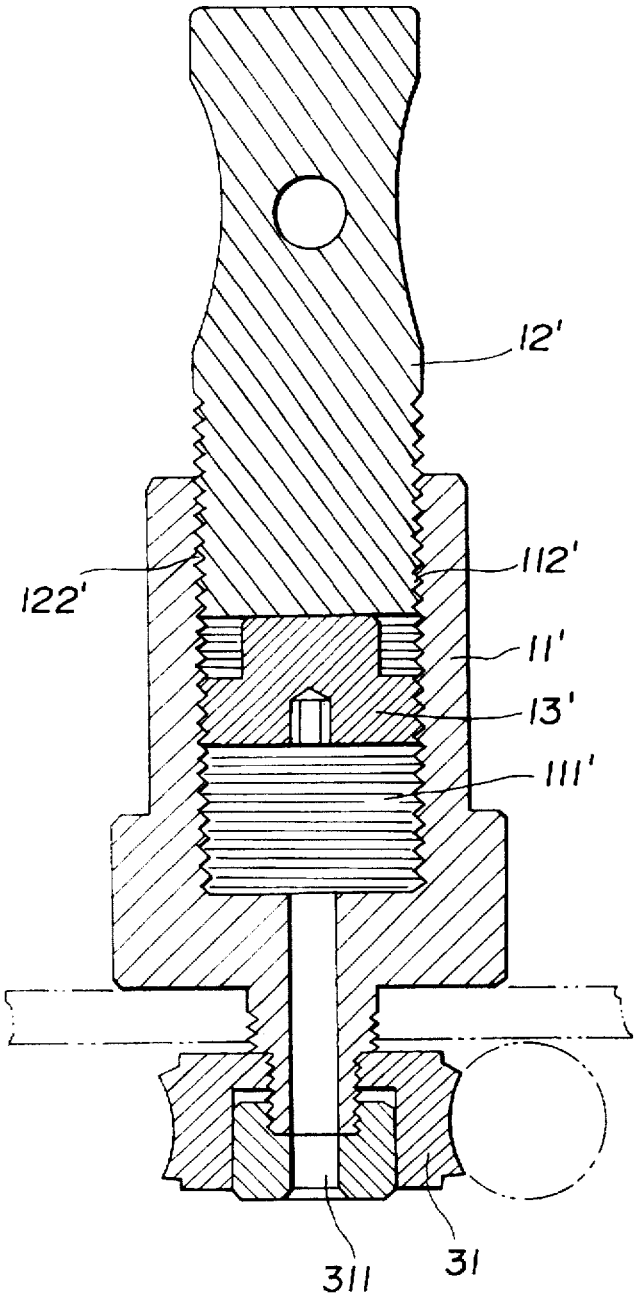
FIG. 5 is a vertical cross sectional front view of a winding shaft according to a second embodiment of the present invention.
Figure 6:
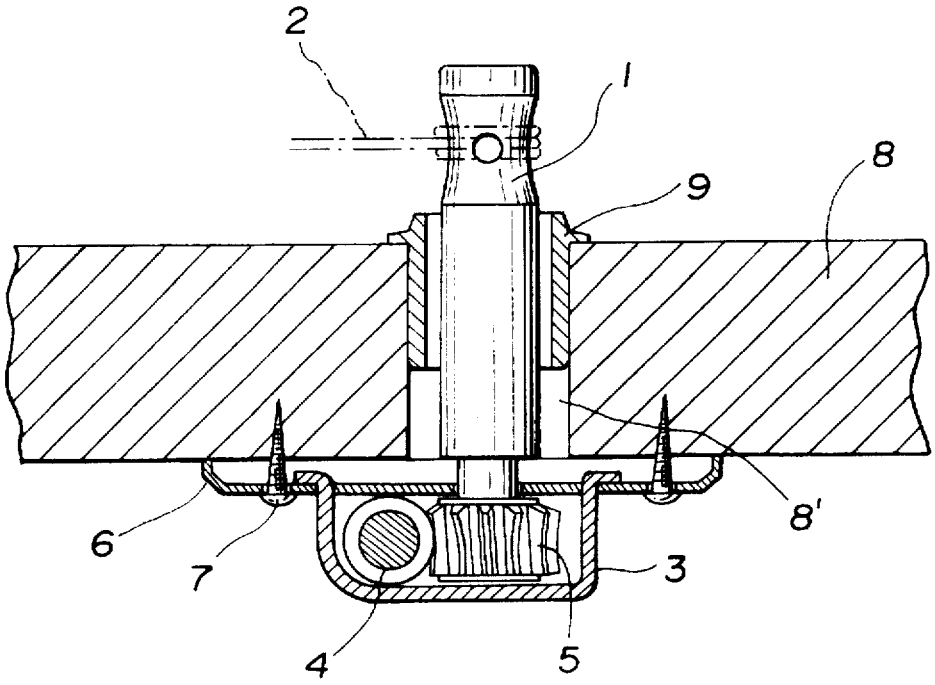
FIG. 6 is a front view that is partially in cross section of a conventional peg of a stringed instrument shown attached to a head portion of a stringed instrument.

A second embodiment of the present invention is described in accordance with the structure illustrated in FIG. 5. In this illustration, an adjustable shaft portion 12' is threaded and inserted into a base shaft portion 11'. Here the upper portion of a threaded hole 111' is formed into a female threaded portion 122', and the lower portion of the adjustable shaft portion 12' is formed into a male threaded portion 112'.

In general, this arrangement is designed so that the female threaded portion 122' and the threaded hole 111' have their threads formed in the same direction such that the threads can be commonly used by the male threaded portion 112' and the fixing screw member 13'.

However, in a case where the adjustable shaft portion 12' and the fixing screw members 13' are intended to be operated in opposite directions when the tension of the string is supplied to the winding shaft 10, the interior of the base shaft portion 11' is sectioned into two areas including an upper portion, i.e. the female threaded portion 122' having threads formed in one direction, and a lower portion, i.e. the threaded hole 111', having threads formed in the opposite direction.

Because the peg according to the present invention as described in the above embodiments enables the shaft length of a winding shaft 10 to be freely adjusted, the angles between the strings and the head portion can be uniformly adjusted by elongating the winding shaft of the peg near the nut device, and by shortening the winding shaft of the peg that is distant from the nut device. Thus the stress that is applied to the nut device can be adjusted as desirable. Moreover, because the same type of pegs can be used for many different types of stringed instruments, inexpensive mass production and sales can be realized for the peg.

Moreover, because the peg of a stringed instrument according to the present invention can control the pressure applied to the nut by the strings to an appropriate uniform value, the frictional resistance between each string and the nut device, in a case where a tremolo device is used, can also be adjusted to the appropriate value, so that restoration of each string can be smoothly performed. This can provide an improved tremolo effect.

Furthermore, because the peg according to the present invention enables the adjustable shaft portion to be removed from the base shaft portion, the adjustable shaft portion could be easily replaced with one having a required or desired structure or design, even after the peg has been attached to the head portion.

In further accord with the present invention, because the stresses applied by the respective strings to the nut device can be individually adjusted by varying the shaft length of the winding shaft 10 of each peg, it is possible to readily meet the particular requirements of different instruments, as in the case of the aforementioned five string-type bass guitars in which it is required to adjust the stress applied by a certain string to the nut device to a specific range.

While several embodiments of the present invention have been described above with respect to specific features thereof, it should be emphasized that these embodiments are exemplary, and are not to be taken in a limiting sense. Rather, the scope of the present invention is as defined by the appended claims.

I claim:

1. A peg for a stringed instrument, comprising:

a winding shaft comprising a base shaft portion having a free end and an adjustable shaft portion having a bottom surface, said adjustable shaft portion being in threaded engagement with said free end of said base shaft portion;

a worm gear, said base shaft portion being connected with said worm gear;

a fixing screw member located in said base shaft portion that is axially engageable with said bottom surface of said adjustable shaft portion.

2. The peg of claim 1, wherein said adjustable shaft portion is axially adjustable relative to said base shaft portion and said fixing screw member is axially adjustable relative to said base shaft portion to engage said bottom surface of said adjustable portion.

3. The peg of claim 1, wherein said adjustable shaft portion comprises one of a first female thread and a first male thread and said base shaft portion comprises the other of said first female thread and said first male thread, said first male thread being engaged with said first female thread.

4. The peg of claim 3, wherein said fixing screw member comprises a second thread engaged with the other of said first female thread and said first male thread.

5. The peg of claim 4, wherein the other of said first female thread and said first male thread is said first female thread, and said second thread is a second male thread.

6. The peg of claim 3, wherein said adjustable shaft portion comprises said first female thread and said base shaft portion comprises said first male thread.

7. The peg of claim 6, wherein said base shaft portion further comprise a second female thread and said fixing screw member comprises a second male thread engaged with said second female thread.

8. The peg of claim 7, wherein said first and second female threads are opposite in thread direction.

9. The peg of claim 1, wherein said fixing screw member is threadedly engaged with said base shaft portion by threads that are opposite in thread direction to the threaded engagement between said adjustable shaft portion and said base shaft portion.

10. The peg of claim 1, wherein said base shaft portion has an opening therein through which said fixing screw member can be accessed.

11. The peg of claim 10, wherein said fixing screw member has a front surface for engagement with said bottom surface of said adjustable shaft portion and a rear surface having a tool engaging formation, aid tool engaging formation facing said opening of said base shaft portion.

12. The peg of claim 11, wherein said base shaft portion has a second end opposite to said free end, said worm gear being connected to said base shaft portion at said second end, and said opening being located at said second end.

13. The peg of claim 1, wherein said adjustable shaft portion comprises a string winding surface.

14. The peg of claim 1, wherein said free end of said base shaft portion comprises a male threaded portion, a central portion of said adjustable shaft portion comprise a female threaded portion facing said base shaft portion, a threaded hole is formed in a central portion of said base shaft portion, said threaded hole communicates externally of said base shaft portion through a central portion of said worm gear, said fixing screw member is threaded into said threaded hole of said base shaft portion such that a top surface of said fixing screw member projects above said male threaded portion of said base shaft portion, and said fixing screw member comprises, on an end surface thereof opposite to said top surface, a tool receiving portion.

15. The peg of claim 14, wherein said tool receiving portion comprises a wrench hole.

16. The peg of claim 14, wherein said male threaded portion of said base shaft portion and said female threaded portion of said adjustable shaft portion are formed with threads that are adapted to urge said adjustable shaft portion toward said base shaft portion when a string is wrapped around said adjustable shaft portion and has tension applied thereto.

17. The peg of claim 14, wherein said threaded hole in said base shaft portion and said fixing screw member that is threaded into said threaded hole are formed with threads that are adapted to guide said fixing screw member in a direction in which said fixing screw member tends to project from said threaded hole when a string is wrapped around said adjustable shaft portion and has tension applied thereto.

18. The peg of claim 1, wherein said free end of said base shaft portion comprises a female threaded portion that faces said adjustable shaft portion, said adjustable shaft portion has a male threaded portion formed at an end thereof facing said base shaft portion and threaded with said female threaded portion of said base shaft portion, said base shaft portion comprises a threaded hole communicating continuously with said female threaded portion thereof, said threaded hole being located closer to said worm gear than said female threaded portion, and said fixing screw member is disposed in said threaded hole for engagement with said bottom surface of said adjustable shaft portion, said bottom surface being a bottom surface of said male threaded portion of said adjustable shaft portion.

19. The peg of claim 18, wherein said threads of said female threaded portion of said base shaft portion are formed opposite in direction to threads of said threaded hole.

20. A peg for a stringed instrument, comprising:

a winding shaft having an axis and comprising a base shaft portion and an adjustable shaft portion having an outer string winding surface thereon;

a worm gear, said base shaft portion being connected with said worm gear; and a means for axially adjusting the position of said outer string winding surface relative to said worm gear and said base shaft portion and axially fixing said outer string winding surface in relation to said worm gear and said base shaft portion in an axially fixed position such that, when string is wound on said string winding surface and tension applied thereto tending to cause said adjustable shaft portion to rotate, said adjustable shaft portion and thus said outer string winding surface remain in said axially fixed position.

* * * * *